US011213930B2

(12) United States Patent
Peng et al.

(10) Patent No.: US 11,213,930 B2
(45) Date of Patent: Jan. 4, 2022

(54) JIG STRUCTURE FOR ASSEMBLING HIGH FREQUENCY CONNECTOR

(71) Applicant: F TIME TECHNOLOGY INDUSTRIAL CO., LTD., New Taipei (TW)

(72) Inventors: Chang-Lin Peng, New Taipei (TW); Chien-Chang Huang, New Taipei (TW)

(73) Assignee: F TIME TECHNOLOGY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 17/088,916

(22) Filed: Nov. 4, 2020

(65) Prior Publication Data

US 2021/0276160 A1 Sep. 9, 2021

Related U.S. Application Data

(63) Continuation-in-part of application No. 16/812,135, filed on Mar. 6, 2020, now abandoned.

(51) Int. Cl.
*B25B 11/02* (2006.01)

(52) U.S. Cl.
CPC ..... *B25B 11/02* (2013.01); *Y10T 29/53265* (2015.01)

(58) Field of Classification Search
CPC ..... H01R 43/26; B25B 11/02; B25B 1/103; Y10T 29/53174; Y10T 29/53209; Y10T 29/53257; Y10T 29/53265
USPC ..... 29/832, 739, 747, 758, 760
See application file for complete search history.

(56) References Cited

U.S. PATENT DOCUMENTS 4,821,393 A * 4/1989 Spigarelli ..... H05K 13/022 29/759
5,497,980 A * 3/1996 Chick ..... B25B 1/103 269/154
7,618,028 B2 * 11/2009 Huisken ..... B23Q 3/18 269/63
11,005,346 B2 * 5/2021 Matsumoto ..... H02K 15/066

* cited by examiner

*Primary Examiner* — Donghai D Nguyen
(74) *Attorney, Agent, or Firm* — Guice Patents PLLC

(57) ABSTRACT

A jig structure for assembling a high frequency connector includes a base on which a rotatable seat is provided, and the surface area of the rotatable seat is smaller than the base. A fixed table is provided on the rotatable seat. The fixed table further includes a first table, and an adjusting rod and a plurality of guide rods are provided on the first table. A plurality of assembly tables are provided on the adjusting rod and the guide rods. The assembly tables are correspondingly disposed, and their movement is controlled by the adjusting rod. A first assembly table and a second assembly table are provided on both sides of the fixed table. The first assembly table has movements along X-axis and Y-axis, and the second assembly stage has movements along Y-axis, thereby corresponding to the relative position of the assembly table and the fixed table so as to quickly place the circuit boards and connectors to be assemble.

10 Claims, 8 Drawing Sheets

JIG STRUCTURE FOR ASSEMBLING HIGH FREQUENCY CONNECTOR

CROSS REFERENCE TO RELATED APPLICATION

This application is a continuation in part of the U.S. Patent Application Ser. No. 16/812,135, filed on Mar. 6, 2020.

BACKGROUND OF THE INVENTION

Field of the Invention

The invention relates to a jig, and more particularly to a jig structure for assembling high frequency connector.

Description of the Related Art

With the vigorous development of the audio-video communication industry, various electronic products continue to pursue better transmission quality and immediacy, and provide diversified applications. These requirements force the signal transmission speed to continue to develop to a high speed. Therefore, the connector as a communication device has become one of the important components of various electronic products.

At present, the production of high frequency connectors still requires manual visual assembly. The assembly method is to use visual methods to magnify the connector through a magnifying glass, and align the central terminal the high frequency connector with the center of the PCB board. The board must be firmly propped against the joint body, and then the fixing screws on both sides are locked. It cannot be continuously produced and assembled.

In such an assembly method, since the size of the central terminal of the high frequency connector is so small that the PCB center cannot ensure the alignment. In addition, the time spent for the manual visual alignment is longer, personnel costs is increased and relative efficiency cannot be improved. It has become the main problem in manufacturing.

BRIEF SUMMARY OF THE INVENTION

In view of the above-mentioned shortcomings, an object of the invention is to provide a jig structure for assembling high frequency connectors, and to quickly locate and assemble the connector components by using a set working tables to reduce the misalignment of manual positioning, increase assembly accuracy, and also improve the yield of the assembled connector.

The invention provides a jig structure for assembling a high frequency connector. The jig structure includes a base on which a rotatable seat is provided. A surface area of the rotatable seat is smaller than that of the base. The rotatable seat is capable of rotating for 360-degree. A fixed table is provided on the rotatable seat. The fixed table further includes a first table. A fixing post is provided at a bottom of each corner end of the first table. A first fixing plate is provided on both sides of the first table. A second fixing plate is symmetrically disposed with the first fixing plate. A first through hole is provided on the first fixing plate, and a groove is provided on the second fixing plate. An adjusting rod extends through the through hole and groove. One end of the adjusting rod is fixed in the groove, the other end of the adjusting rod reaches the other side of the first fixing plate. A handle is provided on the other end to rotate the adjusting rod. A plurality of guide rods are disposed between the second fixing plates and arranged in parallel below the adjusting rod. A plurality of assembly tables are provided on the adjusting rods and the guide rods, and the assembly tables are correspondingly arranged and adjusted by the adjusting rods. A first assembly table and a second assembly table are provided on both sides of the fixed table. The first assembly table has a movement along an X axis and a Y axis, and the second assembly table has a movement along the Y axis, thereby corresponding to the relative position of the assembly table of the fixed table to facilitate rapid placement and assembly of the circuit boards and connectors to be assembled.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
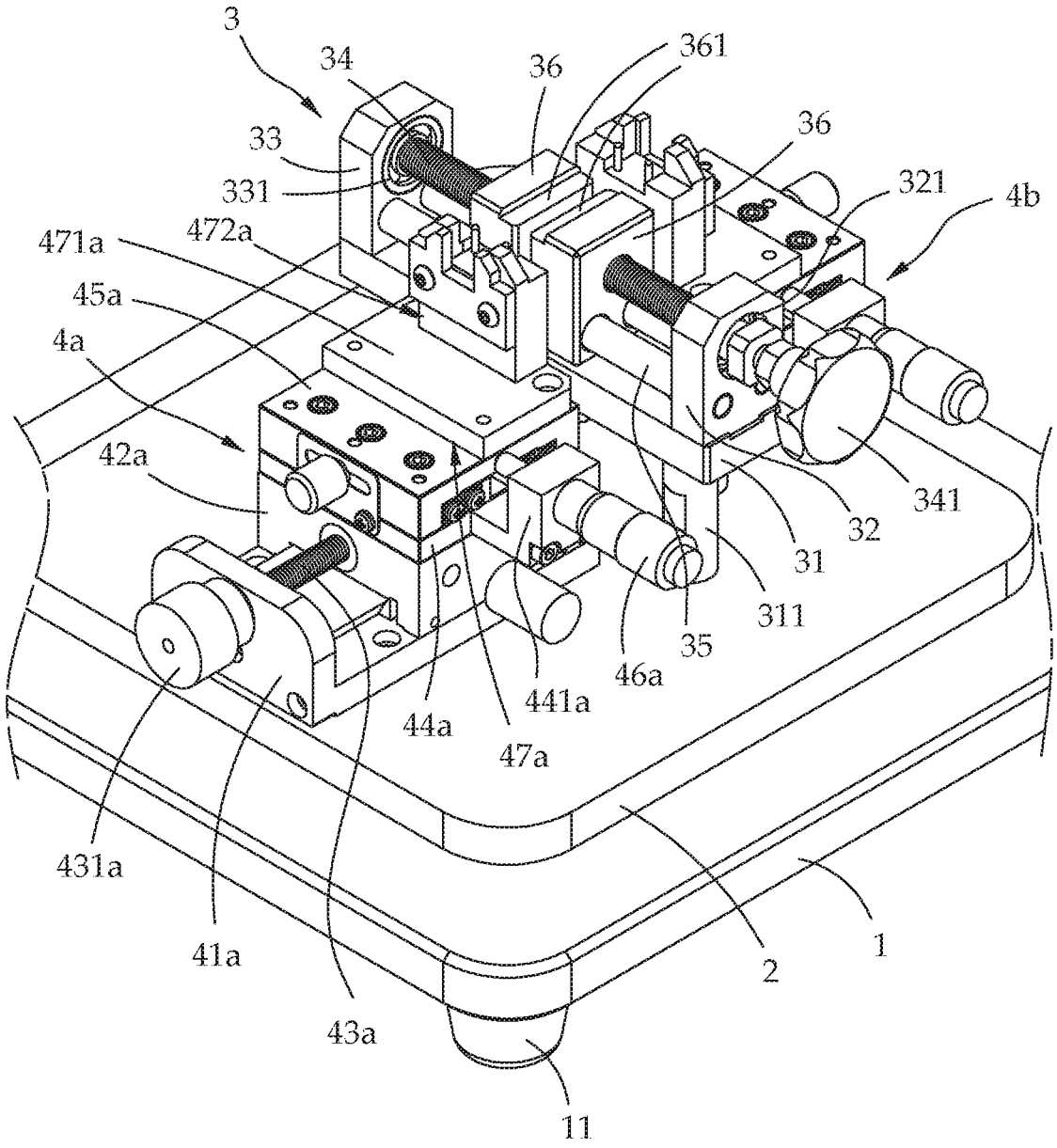
FIG. 1 is a perspective view of an embodiment of a jig structure of the invention.
Figure 6:
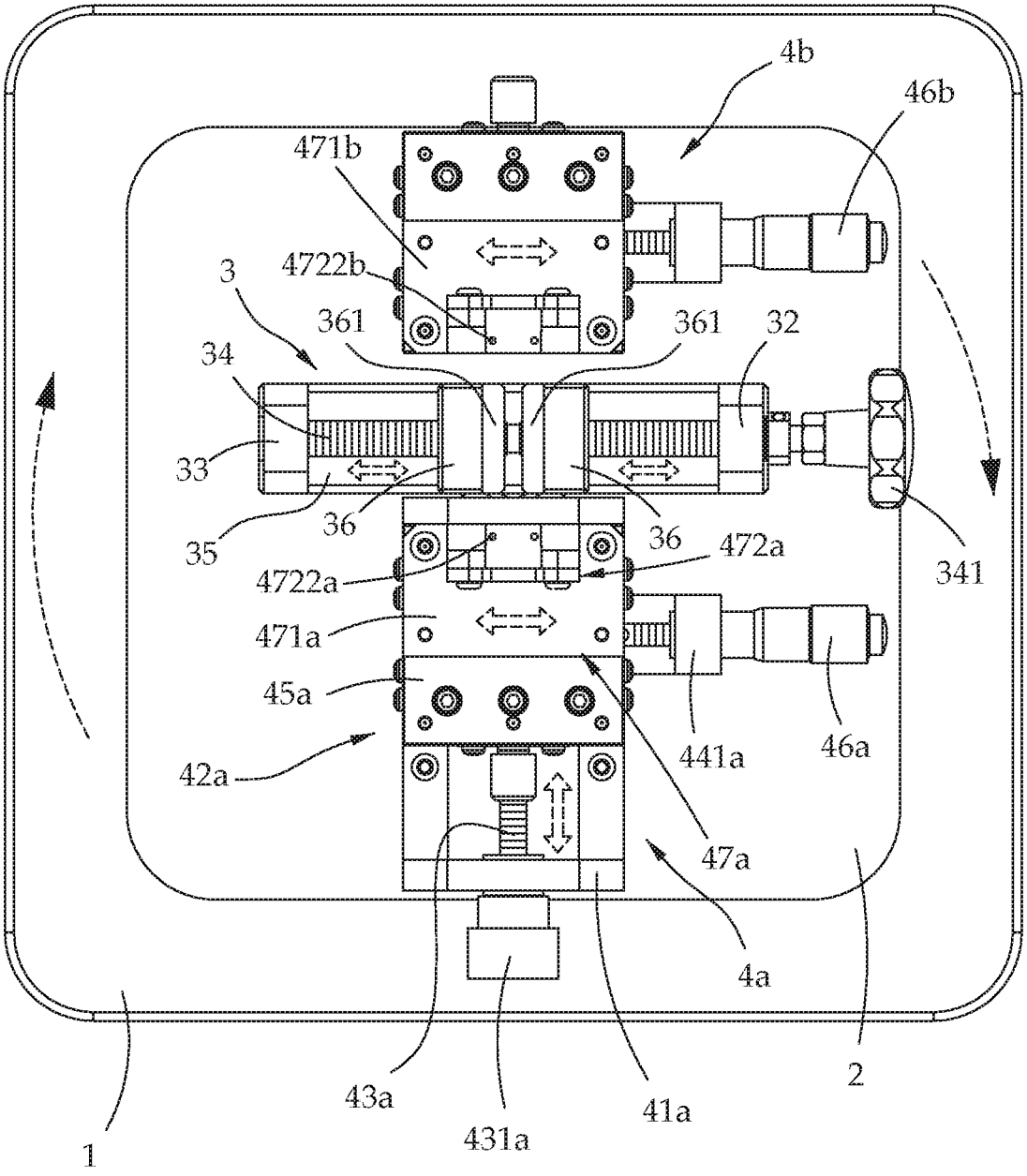
FIG. 6 depicts another operation of a jig structure of the invention.

Please refer to FIG. 1, which is a perspective view of a jig structure of this invention. The jig structure of this invention mainly includes a base 1 which is a rectangular plate. Each corner end of the base 1 is provided with a support column 11 for stably supporting the base 1. A rotatable seat 2 is provided on the base 1. The rotatable seat 2 is a rectangular plate, and the surface area of the rotatable seat 2 is smaller than the base 1, the rotatable seat 2 is capable of rotating for 360 degrees. The rotation is shown in another operation diagram of FIG. 6.

Referring to FIG. 1 again, a fixed table 3 is provided on the rotatable seat 2. The fixed table 3 has a first table 31. Each corner end of the first table 31 is provided with a fix post 311 to support the first table 31 to a certain height. A first fixing plate 32 and a second fixing plate 33 are provided on both sides of the first table 31. The first fixing plate 32 and the second fixing plate 33 are symmetrically arranged. A first through hole 321 is provided on the first fixing plate 32, and a groove 331 is provided on the second fixing plate 33. The position of the groove 331 corresponds to the first through hole 321. An adjusting rod 34 is provided between the fixing plate 32 and the second fixing plate 33. The adjusting rod 34 extends through the first through hole 321. One end of the adjusting rod 34 is fixed in the groove 331, and the other of the adjusting rod 34 extends to the other side of the first fixing plate 32. A handle 341 is provided on the other end. The adjusting rod 34 is rotated through the handle 341. A plurality of guide rods 35 are provided between the first fixing plate 32 and the second fixing plate 33, and the guide rods 35 are parallel arranged below the adjusting rod 34. A plurality of assembly tables 36 are arranged on the adjusting rod 35 and the guide rods 35. The assembly tables 36 are used for placing and fixing the work piece to be assembled. The assembly tables 36 are correspondingly arranged and controlled by the adjusting rod 35. The movement of the assembly tables 36 are controlled through the rotation of the adjusting rod 35. Each assembly table 36 is provided with a chamfered engaging slot 361, and the chamfering directions of the engaging slots 361 correspond to each other to hold the work piece to be assembled.

Figure 2:
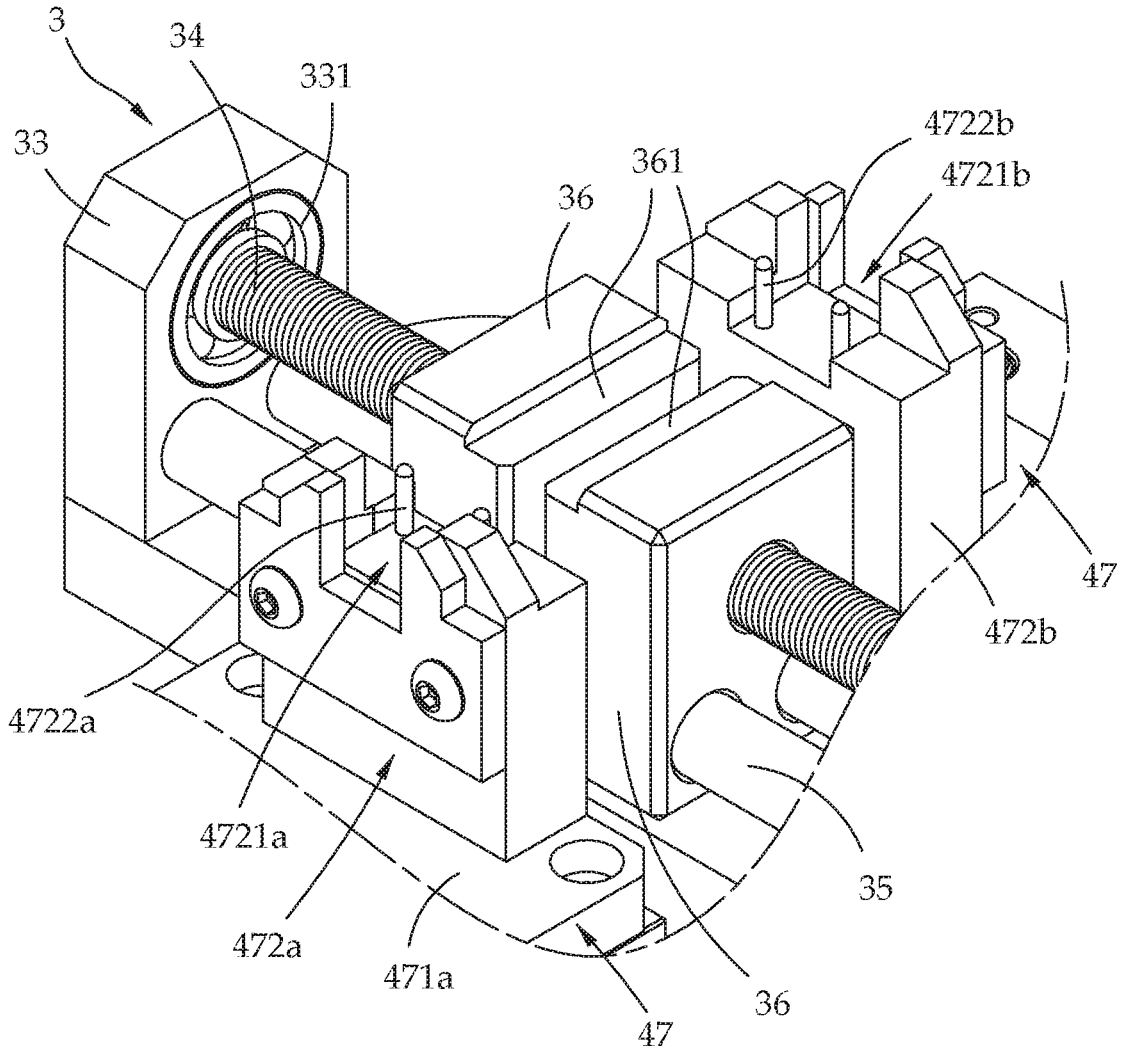
FIG. 2 is an enlarged view of a portion of a jig structure of the invention.
Figure 3:
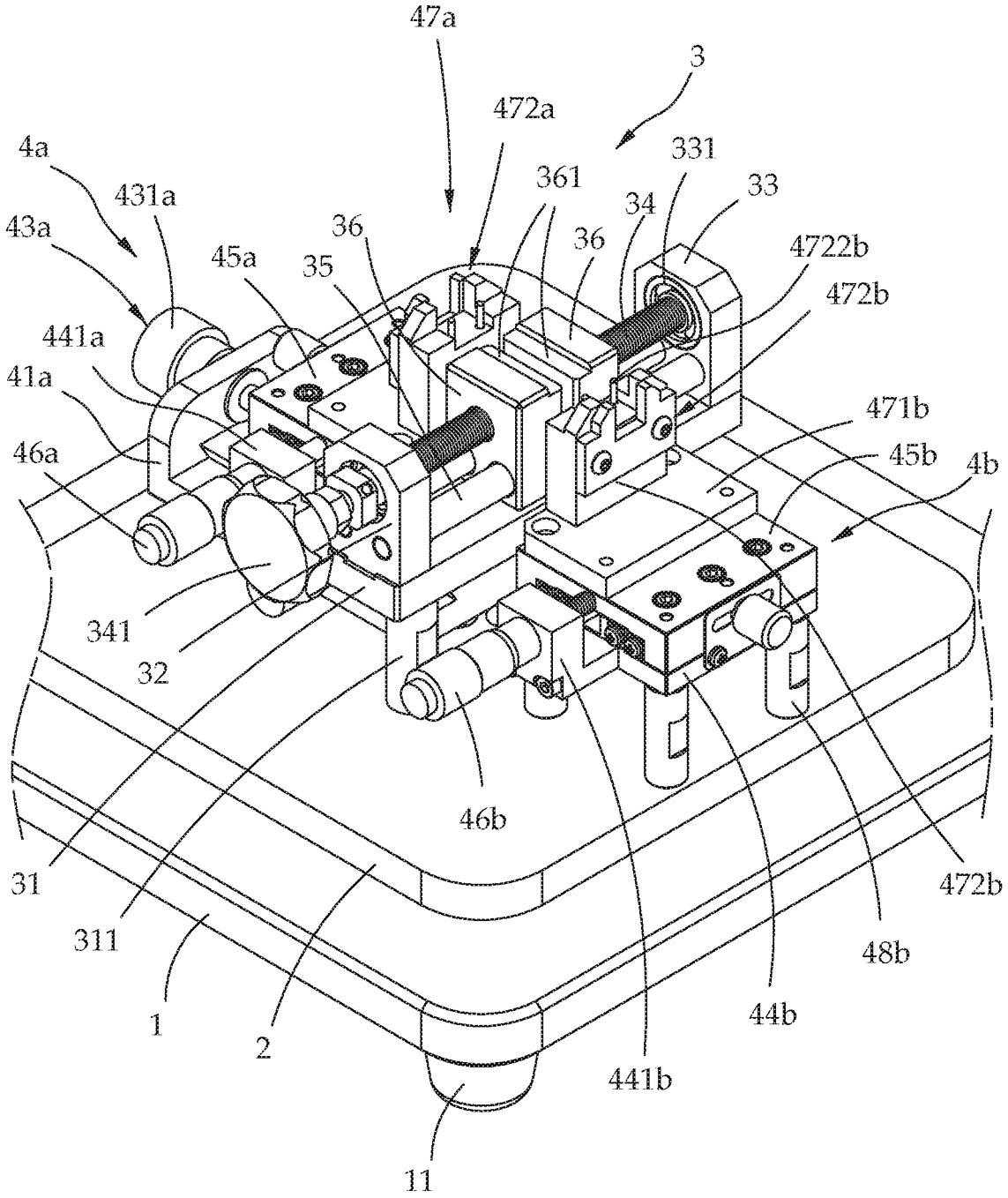
FIG. 3 depicts an assembly view of a jig structure of the invention.

Referring to FIG. 1 again, a first assembly table 4*a* and a second assembly table 4*b* are provided on the rotatable seat 2. The first assembly table 4*a* and the second assembly table 4*b* are respectively disposed on both sides of the fixed table 3. The first assembly table 4*a* and the second assembly table 4*b* operate independently. The first assembly table 4*a* has a base plate 41*a*, which is L-shaped. A first movable table 42*a* is provided on the base plate 41*a*. A first movable table 42*a* is connected with a rotating rod 43*a*. One end of the rotating rod 43*a* is connected to the base plate 41*a*. A rotating button 431*a* is provided on the one end. The rotational rod 43*a* is driven by the knob 431*a*. The rotational rod 43*a* synchronously moves with the first movable table 42*a* to along an X-axis to adjust the relative distance between the first movable table 42*a* and the fixed table 3. An adjusting base 44*a* is further provided on the first movable table 42*a*. A fixed plate 441*a* extends on one side of the adjusting base 44*a*, a second movable table 45*a* is provided on the adjusting base 44*a*, and a adjusting rod 46*a* is threaded on the fixed plate 441*a*. The adjusting rod 46*a* is linked with the second movable table 45*a*, so that the second movable table 45*a* has a movement along a Y-axis. That is, a movement parallel to the fixed table 3 is generated. Finally, a fixed base 47*a* is provided on the second movable table 45*a*, wherein the fixed base 47*a* has a fixed base plate 471*a*. A fixed frame 472*a* is provided on the fixed base plate 471*a*. As shown in an enlarged view of a part of the three-dimensional structure shown in FIG. 2, a recessed assembly groove 4721*a* is provided on the top surface of the fixed frame 472*a*. A plurality of guide rods 4722*a* are provided in parallel in the assembly groove 4721*a*. The structure of the second assembly table 4*b* is shown in the assembly diagram of FIG. 3. The bottom structure of the adjustment base 44*b* of the second assembly table 4*b*, the base plate 41*a* and the first movable table 42*a*, are replaced by a plurality of angular posts 48*b*, and the adjusting base 44*b* is supported by the angular posts 48*b*, so that the fixing base 47*b* of the second assembly table 4*b* and the first assembly table 4*a* have identical height.

Figure 4:
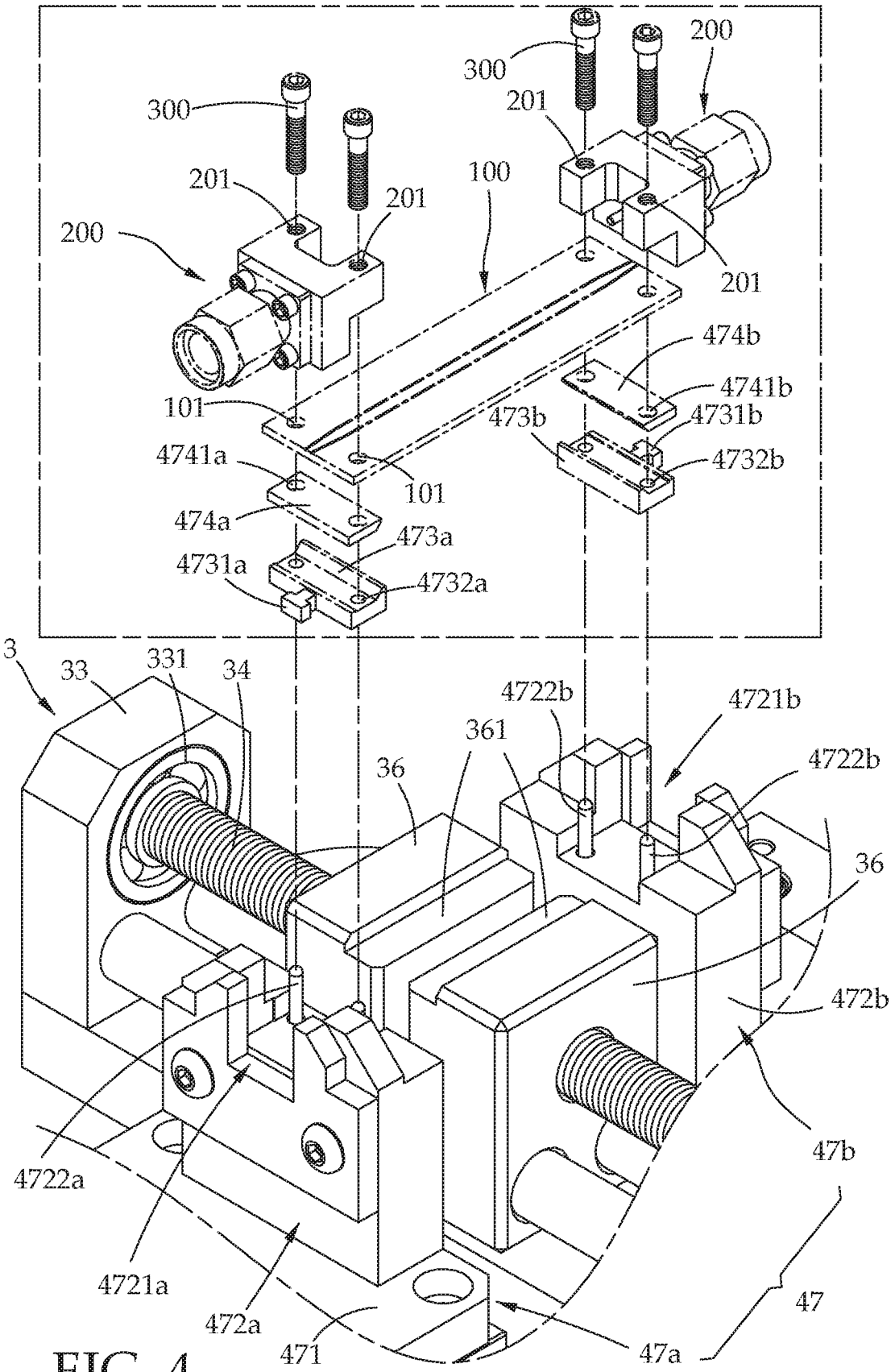
FIG. 4 depicts an operation of a jig structure of the invention.
Figure 5:
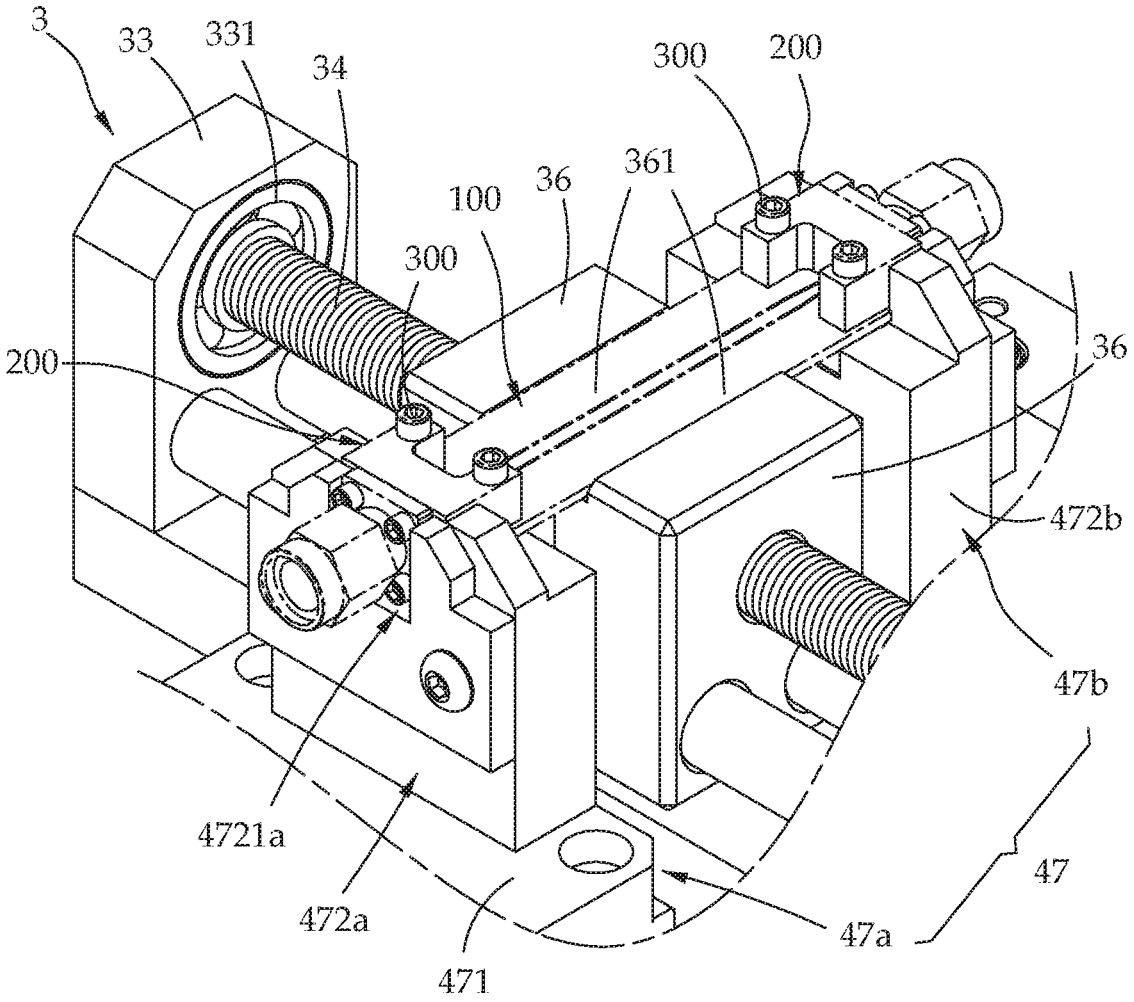
FIG. 5 depicts an operation of a jig structure of the invention.

Referring to FIGS. 4 and 5, which are successive drawings of the schematic diagrams of the assembly operation of the invention. As shown in FIG. 4, the guide rods 4722*a* correspondingly extend through an assembly base plate 473*a*. A bracket 4731*a* extends from one side of the assembly base plate 473*a*, and a plurality of lock holes 4732*a* are formed on the assembly base plate 473*a*. The guide rods 4722*a* are further provided with a pressure plate 474*a*, which are stacked on a top surface of the assembly base plate 473*a*, and a plurality of through holes 4741*a* are provided on a surface of the pressure plate 474*a*. The locking holes 4732*a* should be inserted through by the plurality of screws 475*a* to fix the relative positions of the pressure plate 474*a* and the assembly base plate 473*a*.

As shown in FIG. 5, adjusting the certain the assembly tables 36 of the fixed table 3 to a certain width, and simultaneously adjusting the positions of the first assembly table 4*a* and the second assembly table 4*b* to correspond to the assembly tables 36, so that a circuit board 100 is placed and allow the engaging slot 361 and the first assembly stable 4*a* and the second assembly stable 4*b* of the assembly table 36 to fix the position of the circuit board 100. Two ends of the circuit board 100 have a plurality of second through holes 101, respectively. The second through holes 101 are respectively sleeved on the guide rods 4722*a* and 4722*b*. Then, connectors 200 are respectively placed on the assembly grooves 4721*a* and 4721*b*. The connectors 200 are provided with a plurality of fixing holes 201. The positions of the locking holes exactly correspond to the second through holes 101 of the circuit board 100. A plurality of bolts 300 correspondingly extend through the fixing holes 201 and the second through holes 101, and further extend through the through holes 4741*a* and 4741*b* to screw into the lock holes 4732*a* and 4732*b*, thereby assembling the high frequency connector.

Figure 5A:
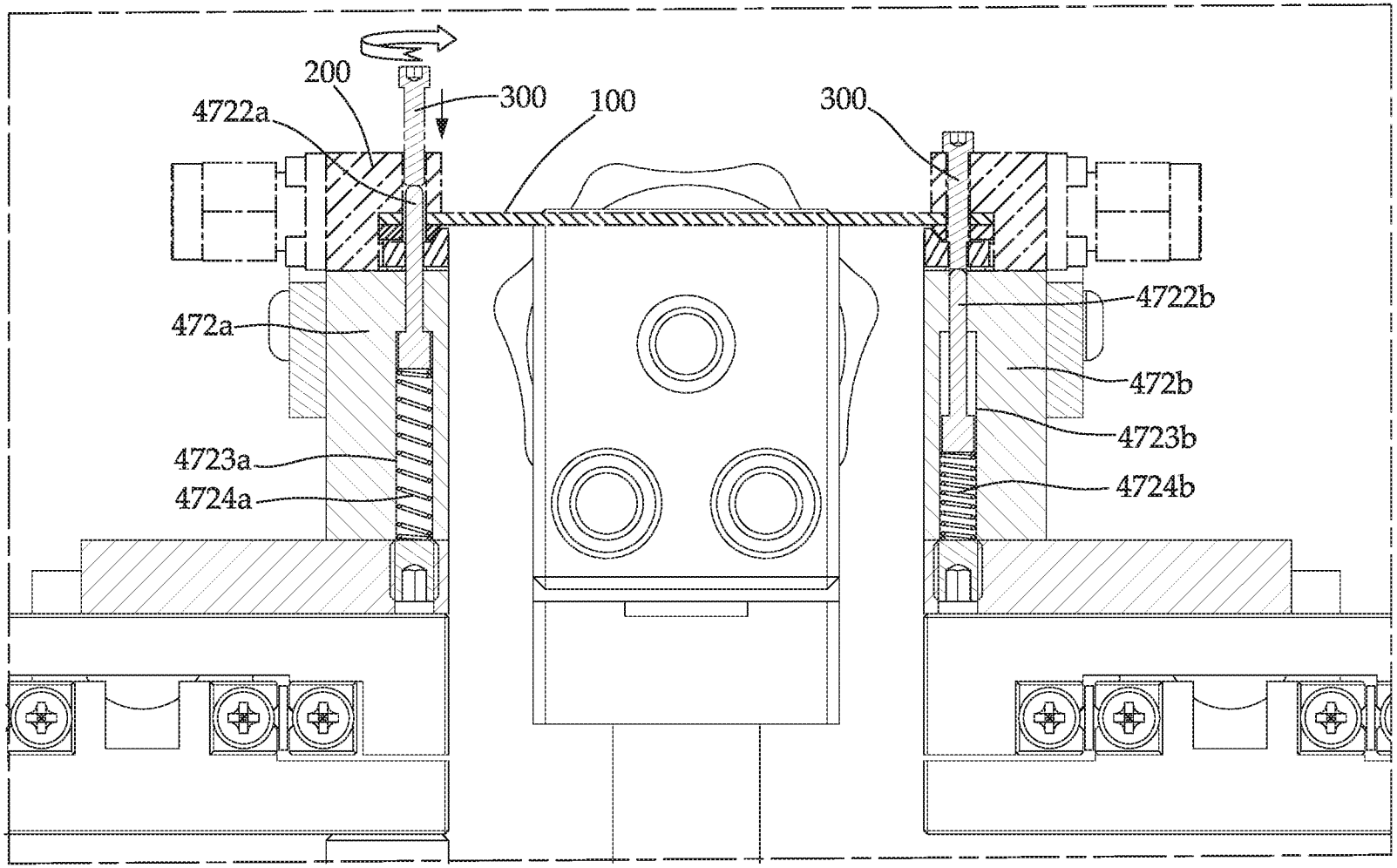
FIG. 5A is a cross section of a jig structure of the invention.

Referring to FIG. 5A, a guiding groove 4723*a* is formed in the fixed frame 472*a*, and a guiding groove 4723*b* is formed in the fixed frame 472*b*. An elastic member 4724*a* is disposed in the guiding groove 4723*a*, and an elastic member 4724*b* is disposed in the guiding groove 4723*b*. The guide rod 4722*a* can move along the guiding groove 4723*a*, and the guide rod 4722*b* can move along the guiding groove 4723*b*. The elastic member 4724*a* props against the guide rod 4722*a*, and the elastic member 4724*b* props against the guide rod 4722*b*. When the bolts 300 screwed into the fixed hole 201, the bolts 300 push the guide rods 4722*a* and 4722*b* to move along the guiding groove 4723*a* and the guiding groove 4723*b* respectively. After the bolts 300 moves through the fixed hole 201, the through hole 101, the through hole 4741*a* to the lock hole 4732*a*, the guide rod 4722*a* completely enters the fixed frame 472*a*. Similarly, After the bolts 300 moves through the fixed hole 201, the through hole 101, the through hole 4741*b* to the lock hole 4732*b*, the guide rod 4722*b* completely enters the fixed frame 472*b*. The connector 200 is fixed to the circuit board 100 through the assembly base plates 473*a*, 473*b* and pressure plates 474*a*, 474*b* to constitute a product. When the assembly of the product is completed, the product is removed from the fixed frames 472*a* and 472*b*. The elastic members 4724*a* and 4724*b* push the guide rods 4722*a* and 4722*b* along the guiding grooves 4723*a* and 4723*b* to protrude from the fixed frames 472*a* and 472*b* respectively.

Figure 7:
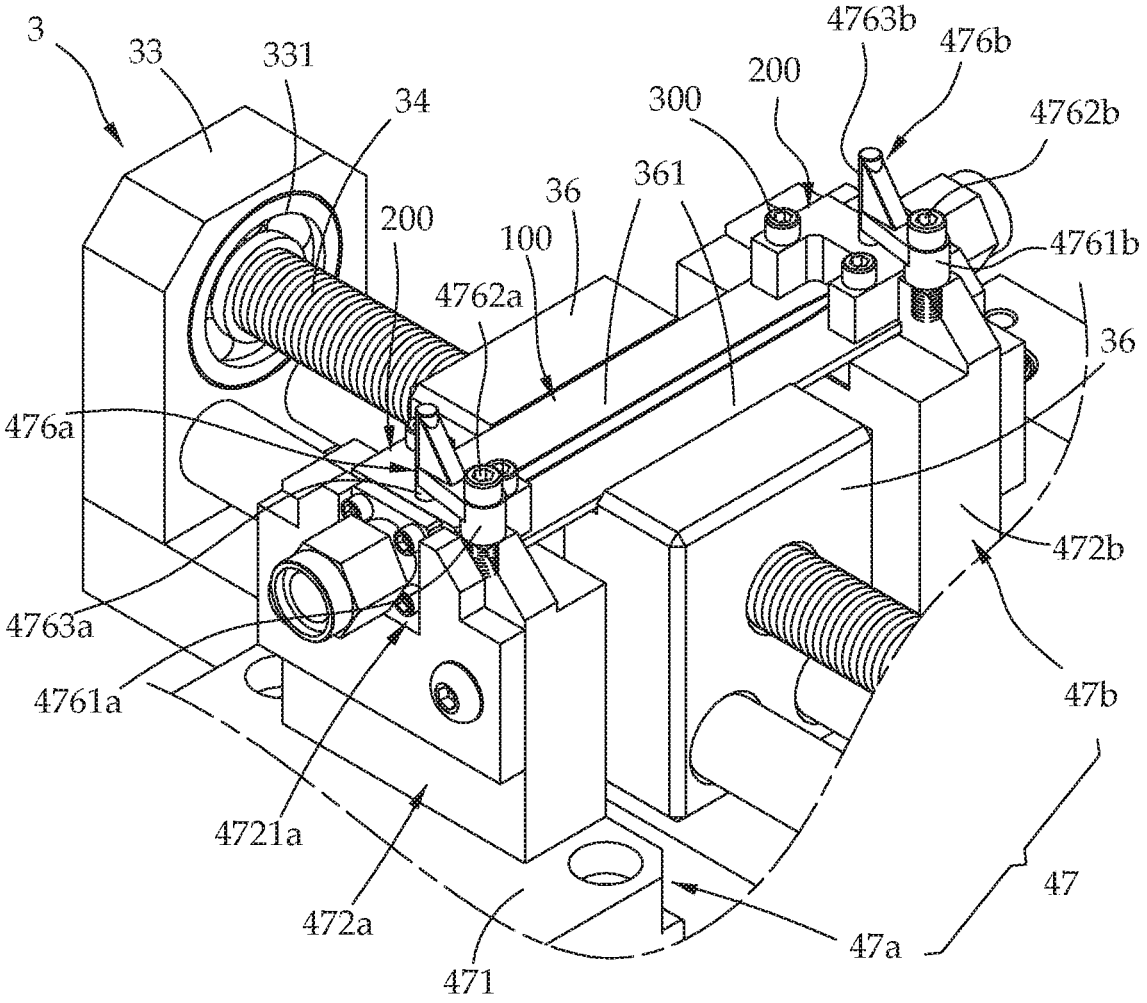
FIG. 7 is a perspective view of another embodiment of a jig structure of the invention.

Referring to the FIG. 7, which is a schematic structural diagram of another embodiment of the present invention. As shown in FIG. 7, pressing joints 476*a* and 476*b* are respectively provided on the top positions of the two fixed frames 472*a* and 472*b*. The pressing joint 476*a* and 476*b* have positioning post 4761*a* and 4761*b* respectively. It is a hollow cylinder. The positioning posts 4761*a* and 4761*b* are correspondingly inserted into positioning rods 4762*a* and 4762*b* respectively to fix the relative positions of the pressing joints 476*a* and 476*b* and the fixed frames 472*a* and 472*b*. Positioning bases 4763*a* and 4763*b* are connected to the positioning posts 4761*a* and 4761*b* respectively. In this embodiment, the positioning bases 4763*a*, 4763*b* are triangular, and the positioning base 4763*a* and 4763*b* corresponds to the guide rods 4722*a*, 4722*b* to be assembled, thereby fixing the connector and preventing the connector from shaking. In addition, in this embodiment, the positioning post 4761*a* and 4761*b* are integrally formed with the positioning bases 4763*a* and 4763*b* respectively.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A jig structure for assembling high frequency connector, comprising:

a fixed table includes:

a first table comprising a fixing post disposed at a bottom of each corner end thereof, a first fixing plate and a second fixing plate symmetrically disposed on two sides of the first base table, a first through hole formed on the first fixing plate and a groove formed on the second fixing plate;

an adjusting rod passing through the first through hole and the groove, wherein one end of the adjusting rod is just fixed in the groove, and the other end of the adjusting rod is disposed on another side of the first fixing plate, and a handle is provided on the other end of the adjusting rod to rotate the adjusting rod;

a plurality of guide rods disposed between the first fixing plate and the second fixing plate, and located in parallel below the adjusting rod;

a plurality of assembly tables disposed on the adjusting rod and the guide rods, wherein the assembly tables are correspondingly disposed and a movement of the assembly tables is controlled by the adjustment rod;

a first assembly table disposed on one side of the fixed table and comprising:

a base plate;

a first movable table disposed on the base plate;

a rotational rod connected to the first movable table with one end connected to the base plate, wherein a knob is disposed on the end, and a movement along an X-axis is generated by synchronously moving the first movable table with the rotational rod;

an adjusting base disposed on the first movable table, wherein a fixed plate extends from one side of the adjusting base;

a second movable table disposed on the adjusting base;

a adjusting rod connected to the fixed plate and the second movable table, wherein the adjusting rod is linked to the second movable table, and the second movable table has a movement along a Y-axis;

a fixed base disposed on the second movable table and comprising:

a fixed base plate;

a fixed frame disposed on the fixed base plate, and has a concave assembly groove on a top surface of the fixed frame, wherein a plurality of parallel guide rods are disposed in the assembly groove;

a second assembly table disposed on another side of the fixed table and comprising:

an adjusting base of the second assembly table disposed on the first movable table, wherein a fixed plate of the second assembly table extends from one side of the adjusting base of the second assembly table;

a plurality of angular posts disposed at the bottom of the adjusting base of the second assembly table so as to keep adjusting base of the second assembly table at an identical height;

a second movable table of the second assembly table disposed on the adjusting base of the second assembly table;

a adjusting rod of the second assembly table connected to the fixed plate of the second assembly table and the second movable table of the second assembly table, wherein the adjusting rod of the second assembly table is linked to the second movable table of the second assembly table, and the second movable table of the second assembly table has a movement along a Y-axis;

a fixed base of the second assembly table disposed on the second movable table of the second assembly table comprising:

a fixed base plate;

a fixed frame disposed on the fixed base plate of the second assembly table, and has a concave assembly groove on a top surface of the fixed frame of the second assembly table, wherein a plurality of parallel guide rods are disposed in the assembly groove of the second assembly table.

2. The jig structure as claimed in claim 1, wherein a support column is disposed on each corner of a base, and the support columns are configured to stably support a base.

3. The jig structure as claimed in claim 1, wherein the base and a rotatable seat are rectangular plates.

4. The jig structure as claimed in claim 1, wherein a chamfered engaging slot is formed on each of the assembly tables, and chamfering directions of the engaging slots correspond to each other.

5. The jig structure as claimed in claim 1, wherein the base plate is L-shaped.

6. The jig structure as claimed in claim 1, wherein a pressing joint is respectively disposed on a top of the fixed frames on both sides, and each of the pressing joints has a positioning post penetrating a positioning rod to fix the relative positions of the pressing joints and the fixed frame, and each of the positioning posts is connected to a positioning base configured to attach to each of the guide rods to be assembled, thereby fixing the connector to avoid shaking.

7. The jig structure as claimed in claim 6, wherein the positioning base is triangular.

8. The jig structure as claimed in claim 6, wherein the positioning post is integrated with the positioning base.

9. The jig structure as claimed in claim 1, wherein the fixed base of the first assembly table comprises a first guiding groove and a first elastic member disposed in the first guiding groove, and the fixed base of the second assembly table comprises a second guiding groove and a second elastic member disposed in the second guiding groove, the first elastic member props against a guide rod movable along a first guiding groove, the second elastic member props against the guide rod movable along a second guiding groove.

10. The jig structure as claimed in claim 1, further comprises a base and a rotatable seat provided on the base, wherein the rotatable seat has a surface area smaller than that of the base, the rotatable seat is capable of rotating for 360-degree, the fixed table, the first assembly table and the second assembly table are disposed on the rotatable seat.

* * * * *